US005909231A

United States Patent [19]

Childers et al.

[11] Patent Number: 5,909,231

[45] Date of Patent: Jun. 1, 1999

[54] GAS FLUSH TO ELIMINATE RESIDUAL BUBBLES

[75] Inventors: Winthrop D. Childers, San Diego; Brian J. Keefe, La Jolla; Barbara Parcells, San Diego; Frank Drogo, San Marcos; Shailendra Kumar, San Diego; Steven L. Webb, Temecula; Hanno Ix, Escondido; Kai Kong Iu, San Diego, all of Calif.

[73] Assignee: Hewlett-Packard Co., Palo Alto, Calif.

[21] Appl. No.: 08/550,437

[22] Filed: Oct. 30, 1995

[51] Int. Cl.[6] ..... B41J 2/19

[52] U.S. Cl. ..... 347/92; 347/85

[58] Field of Search ..... 347/85, 92, 9.3, 347/84, 86, 87; 141/6, 37

[56] References Cited

U.S. PATENT DOCUMENTS

| | | |
|---|---|---|
| 3,360,382 | 12/1967 | Miller . |
| 3,804,133 | 4/1974 | Copping . |
| 4,312,009 | 1/1982 | Lange . |
| 4,476,472 | 10/1984 | Aiba et al. . |
| 4,491,433 | 1/1985 | Shiurila et al. . |
| 4,502,060 | 2/1985 | Rankin et al. . |
| 4,558,326 | 12/1985 | Kimura et al. . |
| 4,558,333 | 12/1985 | Sugitani et al. . |
| 4,587,534 | 5/1986 | Saito et al. . |
| 4,611,219 | 9/1986 | Sugitani et al. . |
| 4,683,481 | 7/1987 | Johnson . |
| 4,695,854 | 9/1987 | Cruz-Uribe . |
| 4,712,172 | 12/1987 | Kiyohara et al. . |
| 4,734,717 | 3/1988 | Rayfield . |
| 4,761,269 | 8/1988 | Conger et al. . |
| 4,791,440 | 12/1988 | Eldridge et al. . |
| 4,847,630 | 7/1989 | Bhaskar et al. . |
| 4,882,595 | 11/1989 | Trueba et al. . |
| 4,935,751 | 6/1990 | Hamlin . |
| 4,940,995 | 7/1990 | Hine et al. . |
| 4,942,408 | 7/1990 | Braun . |
| 4,948,427 | 8/1990 | Yamagishi et al. . |
| 4,968,998 | 11/1990 | Allen . |
| 4,999,650 | 3/1991 | Braun . |
| 5,059,989 | 10/1991 | Eldridge et al. . |
| 5,060,449 | 10/1991 | Klarl . |
| 5,071,667 | 12/1991 | Grune et al. . |
| 5,302,185 | 4/1994 | Steinleitner . |
| 5,369,429 | 11/1994 | Erickson . |
| 5,396,268 | 3/1995 | Mader et al. . |
| 5,413,153 | 5/1995 | Zwilling et al. . |

FOREIGN PATENT DOCUMENTS

| | | |
|---|---|---|
| 314 486 | 5/1989 | European Pat. Off. ..... B41J 3/04 |

*Primary Examiner*—N. Le
*Assistant Examiner*—Judy Nguyen

[57] ABSTRACT

In a inkjet print cartridge ink flows from the reservoir around the edge of the silicon substrate before being ejected out of the nozzles. During operation, warm thermal boundary layers of ink form adjacent the substrate and dissolved gases in the thermal boundary layer of the ink form the bubbles. If the bubbles to grow larger than the diameter of subsequent ink passageways these bubbles choke the flow of ink to the vaporization chambers. This results in causing some of the nozzles of the printhead to become temporarily inoperable. The disclosure describes a method of avoiding such a malfunction in a liquid inkjet printing system by providing a method for reducing residual air bubbles in an inkjet print cartridge by flushing the empty cartridge by passing carbon dioxide through the fill port or the ink ejection nozzles prior to filling the print cartridge with ink and thereby eliminating residual air bubbles from the print cartridge when the print cartridge is filled with ink.

11 Claims, 8 Drawing Sheets

GAS FLUSH TO ELIMINATE RESIDUAL BUBBLES

CROSS-REFERENCE TO RELATED APPLICATIONS

This application relates to the subject matter disclosed in U.S. patent application Ser. No. 08/550,143, filed Oct. 30, 1995, entitled "Bubble Tolerant Manifold Design for Inkjet Cartridge" which is herein incorporated by reference.

FIELD OF THE INVENTION

The present invention generally relates to inkjet and other types of printers and, more particularly, to the ink flow to the printhead portion of an inkjet printer.

BACKGROUND OF THE INVENTION

An ink jet printer forms a printed image by printing a pattern of individual dots at particular locations of an array defined for the printing medium. The locations are conveniently visualized as being small dots in a rectilinear array. The locations are sometimes called "dot locations", "dot positions", or "pixels". Thus, the printing operation can be viewed as the filling of a pattern of dot locations with dots of ink.

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters or other images to be printed upon the paper as the printhead is moved relative to the paper. The paper is typically shifted each time the printhead has moved across the paper. The thermal inkjet printer is fast and quiet, as only the ink strikes the paper. These printers produce high quality printing and can be made both compact and affordable.

An inkjet printhead generally includes: (1) ink channels to supply ink from an ink reservoir to each vaporization chamber proximate to an orifice; (2) a metal orifice plate or nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a drop of ink to be ejected through an associated nozzle onto the paper.

A concern with inkjet printing is the sufficiency of ink flow to the paper or other print media. Print quality is a function of ink flow through the printhead. Too little ink on the paper or other media to be printed upon produces faded and hard-to-read documents.

In an inkjet printhead ink is fed from an ink reservoir integral to the printhead or an "off-axis" ink reservoir which feeds ink to the printhead via tubes connecting the printhead and reservoir. Ink is then fed to the various vaporization chambers either through an elongated hole formed in the center of the bottom of the substrate, "center feed", or around the outer edges of the substrate, "edge feed". In center feed the ink then flows through a central slot in the substrate into a central manifold area formed in a barrier layer between the substrate and a nozzle member, then into a plurality of ink channels, and finally into the various vaporization chambers. In edge feed ink from the ink reservoir flows around the outer edges of the substrate into the ink channels and finally into the vaporization chambers. In either center feed or edge feed, the flow path from the ink reservoir and the manifold inherently provides restrictions on ink flow to the firing chambers.

Air and other gas bubbles can cause major problems in ink delivery systems. Ink delivery systems are capable of releasing gasses and generating bubbles, thereby causing systems to get clogged and degraded by bubbles. In the design of a good ink delivery system, it is important that techniques for eliminating or reducing bubble problems be considered. Most fluids exposed to the atmosphere contain dissolved gases in amounts varying with the temperature. The amount of gas that a liquid can hold depends on temperature and pressure, but also depends on the extent of mixing between the gas and liquid and the opportunities the gas has had to escape.

Changes in atmospheric pressure normally can be neglected because atmospheric pressure stays fairly constant. However, temperature does change within an inkjet cartridge to make an appreciable difference in the amount of gas that can be contained in the ink. Bubbles have less tendency to originate at low temperatures, and their growth will also be slower. The colder a liquid, the less kinetic energy is available and the longer it takes to gather together the necessary energy at specific location where the bubble begins to form.

Most fluids exposed to the atmosphere contain dissolved gases in amounts proportional to the temperature of the fluid itself. The colder the fluid, the greater the capacity to absorb gases. If a fluid saturated with gas is heated, the dissolved gases are no longer in equilibrium and tend to diffuse out of solution. If nucleation seed sites are present along the surface containing the fluid or within the fluid, bubbles will form, and as the fluid temperature rises further, these bubbles grow larger.

Bubbles are not only made of air, but are also made of water vapor and vapors from other ink-vehicle constituents. However, the behavior of all liquids are similar, the hotter the liquid becomes, the less gas it can hold. Both gas release and vapor generation cause bubbles to start and grow as temperature rises. One can reasonably assume the gases inside the bubbles in a water-based ink are always saturated with water vapor. Thus, bubbles are made up both of gases, mostly air, and of ink vehicle vapor, mostly water. At room temperature, water vapor is an almost negligible part of the gas in a bubble. However, at 50° C., the temperature at which an inkjet printhead might operate, water vapor adds importantly to the volume of a bubble. As the temperature rises, the water vapor content of the bubbles increases much more rapidly with temperature than does the air content.

The best conditions for bubble generation are the simultaneous presence of (1) generating or "seed" sites, (2) ink flow and (3) bubble accumulators. These three mechanisms work together to produce large bubbles that clog and stop flow in ink delivery systems. When air comes back out of solution as bubbles, it does so at preferential locations, or generation or nucleation sites. Bubbles like to start at edges and corners or at surface scratches, roughness, or imperfections. Very small bubbles tend to stick to the surfaces and resist floating or being swept along in a current of ink. When the bubbles get larger, they are more apt to break loose and move along. However, if the bubbles form in a corner or other out-of-the-way location, it is almost impossible to dislodge them by ink currents.

While bubbles may not start at gas generating sites when the ink is not flowing past those sites, when the ink is moving, the bubble generation site is exposed to a much larger volume of ink containing dissolved gas molecules. As ink flows past the gas generating site, gas molecules can be brought out of solution to form a bubble and grow; while if the ink was not flowing this would happen less rapidly.

The third contributor to bubble generation is the accumulator or bubble trap, which can be defined as any expansion and subsequent narrowing along an ink passage. This configuration amounts to a chamber on the ink flow path with an entrance and an exit. The average ink flow rate, in terms of volume ink per cross section of area per second, is smaller within the chamber than at the entrance or at the exit. The entrance edge of the chamber will act as a gas generating site because of its sharpness and because of the discontinuity of ink flow over the edge. Bubbles will be generated at this site, and when they become large enough they get moved along toward the exit duct until the exit duct is blocked. Then, unless the system can generate enough pressure to push the bubble through, the ink delivery system will become clogged and ink delivery will be shut down. Thus, the chamber allows bubbles to grow larger than the diameter of subsequent ink passageways which may then become blocked.

During the ink filling and priming process, bubbles are left behind in the print cartridge. They are left in the manifold region, between the filters 92 and nozzles, where they can interfere with printhead reliability by causing intermittent nozzle problems and local or even global starvation. Bubbles left behind downstream of the filters 92 can be shocked through the filters 92 and into the manifold.

Previous solutions included eliminating bubble traps in the manifold and filling and priming slowly. Unfortunately, design and manufacturing constraints make eliminating bubble traps prohibitively difficult. Filling and priming slowly enough to assure no bubble trapping would tend to adversely affect manufacturing cycle time. In addition, effectiveness of the slow fill and prime is negated by the bubble traps.

Accordingly, there is a need for a process to eliminate the residual air left in the print cartridge after the ink filling and priming process.

SUMMARY OF THE INVENTION

In a inkjet print cartridge ink flows from the ink reservoir through filters, through a standpipe, through or around the silicon substrate, through ink channels and into vaporization chambers for ejection out of the nozzles. During operation, warm thermal boundary layers of ink form adjacent the substrate and dissolved gases in the thermal boundary layer of the ink form the bubbles. Also, bubbles tend to form at the corners and edges of the walls along the ink flow path. If the bubbles grow larger than the diameter of subsequent ink passageways these bubbles choke the flow of ink to the vaporization chambers. This results in causing some of the nozzles of the printhead to become temporarily inoperable.

The present invention provides a method of avoiding such a malfunction in a liquid inkjet printing system by providing a method for reducing residual air bubbles in an inkjet print cartridge by flushing the empty cartridge by passing carbon dioxide through the fill port or the ink ejection nozzles prior to filling the print cartridge with ink and thereby eliminating residual air bubbles from the print cartridge when the print cartridge is filled with ink.

BRIEF DESCRIPTION OF THE DRAWINGS

The present invention can be further understood by reference to the following description and attached drawings which illustrate the preferred embodiment.

DETAILED DESCRIPTION OF THE PREFERRED EMBODIMENTS

Figure 1:
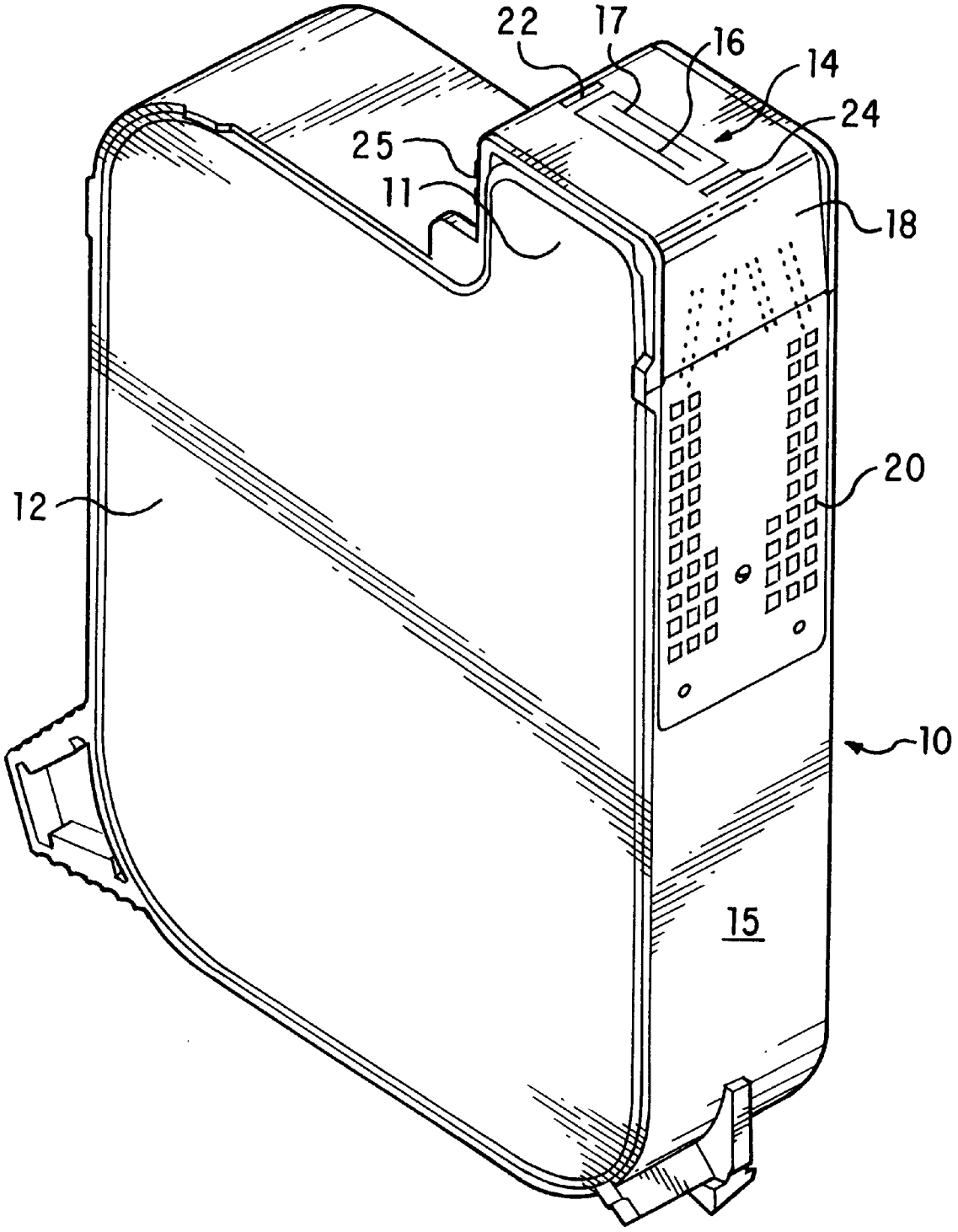
FIG. 1 is a perspective view of an inkjet print cartridge.

Referring to FIG. 1, reference numeral 10 generally indicates an inkjet print cartridge for mounting in the carriage of an inkjet printer. The inkjet print cartridge 10 includes a printhead 14 and an ink reservoir 12, which may be a "integral" reservoir, "snap-on" reservoir, or a "reservoir" for receiving an ink from an off-axis ink reservoir. Print cartridge 10 includes snout 11 which contains an internal standpipe 51 (shown in FIG. 8) for transporting ink to the printhead from the reservoir 12. The printhead 14 includes a nozzle member 16 comprising nozzles or orifices 17 formed in a circuit 18. The circuit 18 includes conductive traces (not shown) which are connected to the substrate electrodes at windows 22, 24 and which are terminated by contact pads 20 designed to interconnect with printer providing externally generated energization signals to the printhead for firing resistors to eject ink drops. Printhead 14 has affixed to the back of the circuit 18 a silicon substrate 28 (not shown) containing a plurality of individually energizable thin film resistors. Each resistor is located generally behind a single orifice 17 and acts as an ohmic heater when selectively energized by one or more pulses applied sequentially or simultaneously to one or more of the contact pads 20.

Figure 2:
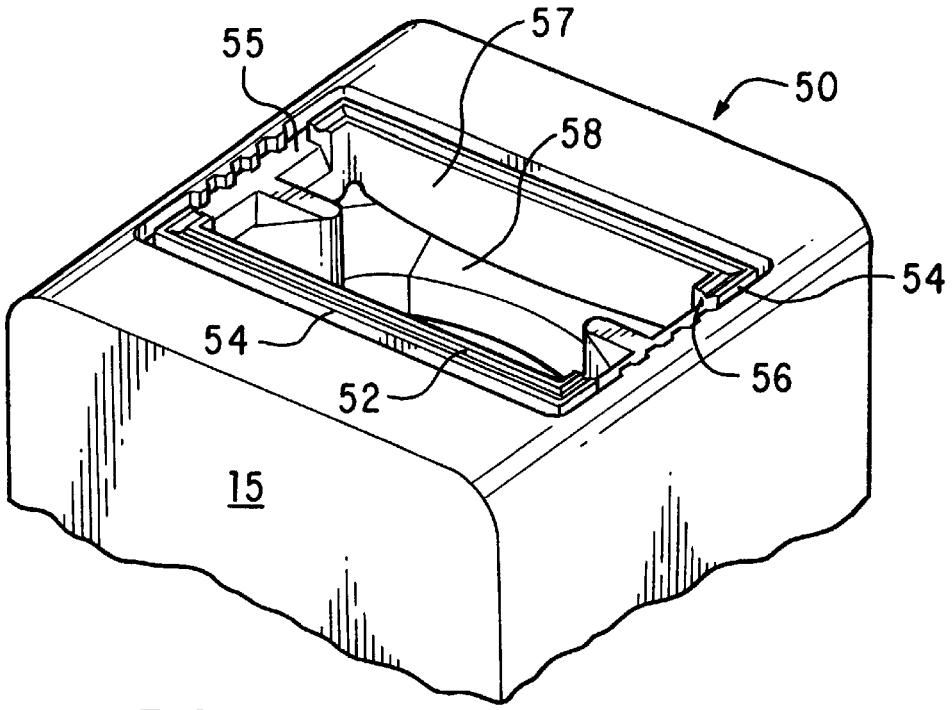
FIG. 2 is a perspective view of the headland area of the inkjet print cartridge of FIG. 1.
Figure 3:
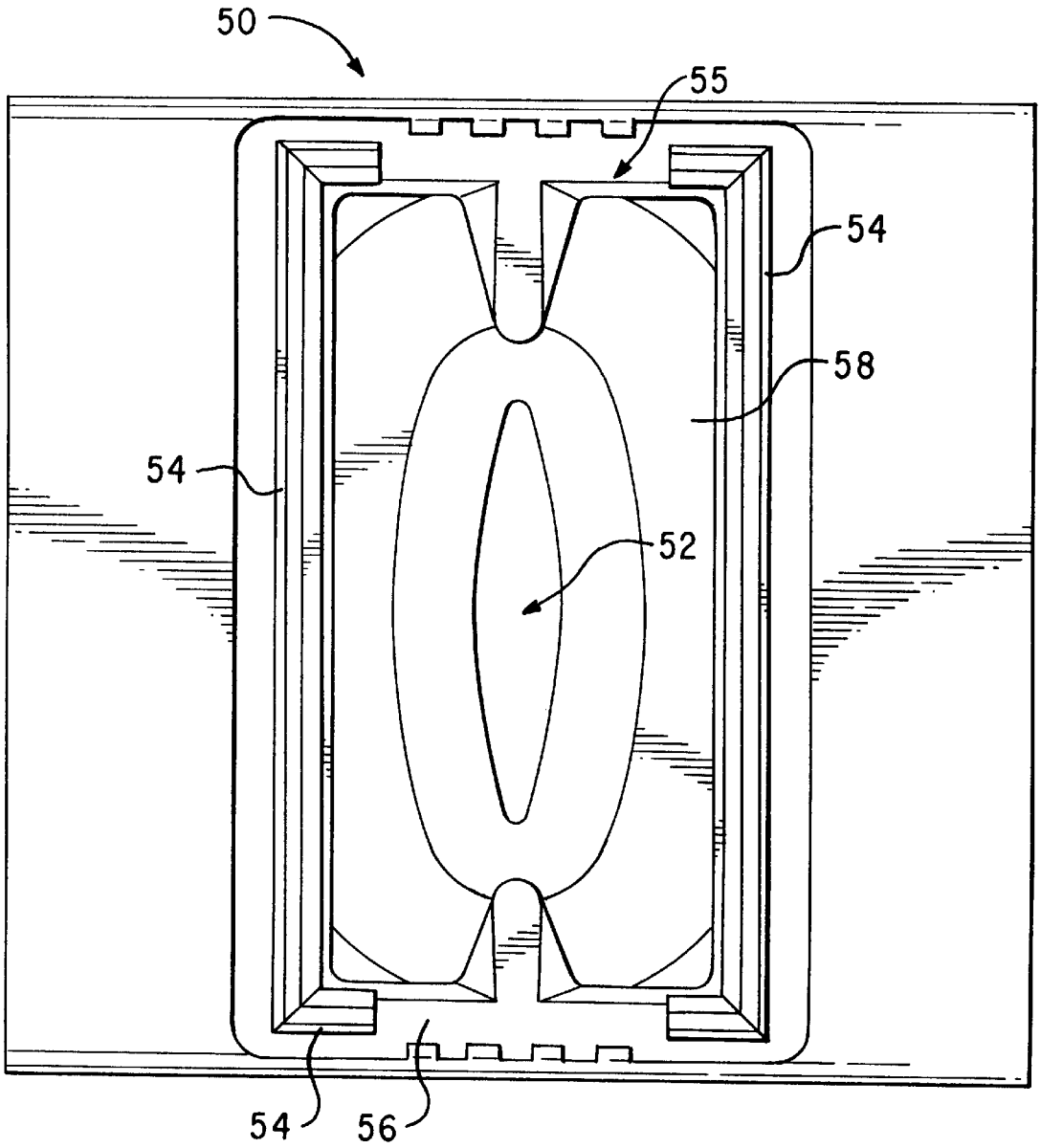
FIG. 3 is a top plan view of the headland area of the inkjet print cartridge of FIG. 7.

FIG. 2 shows the print cartridge 10 of FIG. 1 with the printhead 14 removed to reveal the headland pattern 50 used in providing a seal between the printhead 14 and the print cartridge body 15. FIG. 3 shows the headland area in an enlarged top plan view. Shown in FIGS. 2 and 3 is a manifold 52 in the print cartridge 10 for allowing ink from the ink reservoir 12 to flow to a chamber adjacent the back surface of the printhead 14. The headland pattern 50 formed on the print cartridge 10 is configured so that a bead of epoxy adhesive (not shown) dispensed on the inner raised walls 54 and across the wall openings 55 and 56 will form an ink seal between the body 15 of the print cartridge 10 and the back of the printhead 14 when the printhead 14 is pressed into place against the headland pattern 50.

Figure 4:
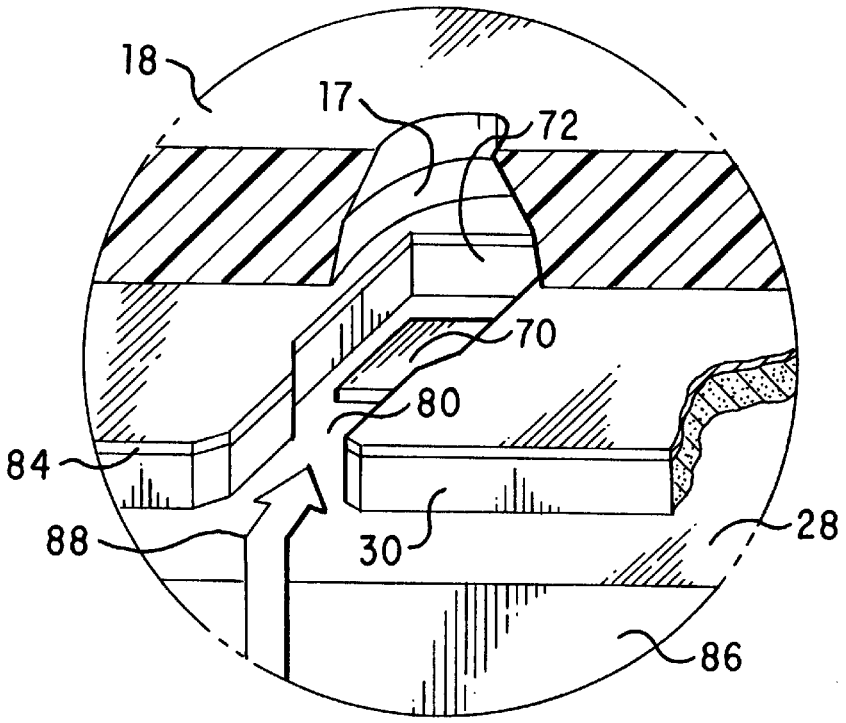
FIG. 4 is a top perspective view, partially cut away, of a portion of the printhead assembly showing the relationship of an orifice with respect to a vaporization chamber, a heater resistor, and an edge of the substrate.

Referring to FIG. 4, shown is an enlarged view of a single vaporization chamber 72, thin film resistor 70, and frustum shaped orifice 17 after the substrate is secured to the back of the circuit 18 via the thin adhesive layer 84. Silicon substrate 28 has formed on it thin film resistors 70 formed in the barrier layer 30. Also formed on the substrate 28 are electrodes (not shown) for connection to the conductive traces (not shown) on the circuit 18. Also formed on the surface of the substrate 28 is the barrier layer 30 in which is formed the vaporization chambers 72 and ink channels 80. A side edge of the substrate 28 is shown as edge 86. In operation, ink flows from the ink reservoir 12 around the side edge 86 of the substrate 28, and into the ink channel 80 and associated vaporization chamber 72, as shown by the arrow 88. Upon energization of the thin film resistor 70, a thin layer of the adjacent ink is superheated, causing explosive vaporization and, consequently, causing a droplet of ink to be ejected through the orifice 17. The vaporization chamber 72 is then refilled by capillary action.

Figure 5:
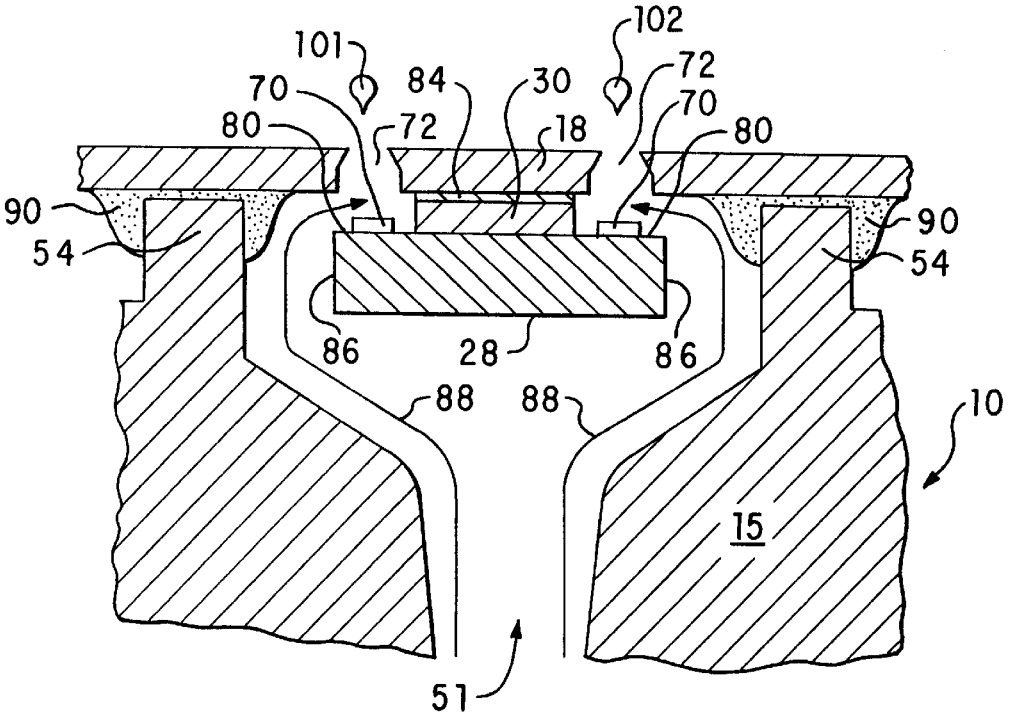
FIG. 5 is a schematic cross-sectional view of a printhead assembly and the print cartridge as well as the ink flow path around the edges of the substrate.

Shown in FIG. 5 is a side elevational cross-sectional view showing a portion of the adhesive seal 90, applied to the inner raised wall 54 portion of the print cartridge body 15 surrounding the substrate 28 and showing the substrate 28 being bonded to a central portion of the circuit 18 on the top surface 84 of the barrier layer 30 containing the ink channels and vaporization chambers 72. A portion of the plastic body 15 of the printhead cartridge 10, including raised walls 54 is also shown.

FIG. 5 also illustrates how ink 88 from the ink reservoir 12 flows through the standpipe 51 formed in the print cartridge 10 and flows around the edges 86 of the substrate 28 through ink channels 80 into the vaporization chambers 72. Thin film resistors 70 are shown within the vaporization chambers 72. When the resistors 70 are energized, the ink within the vaporization chambers 72 are ejected, as illustrated by the emitted drops of ink 101, 102.

Figure 6:
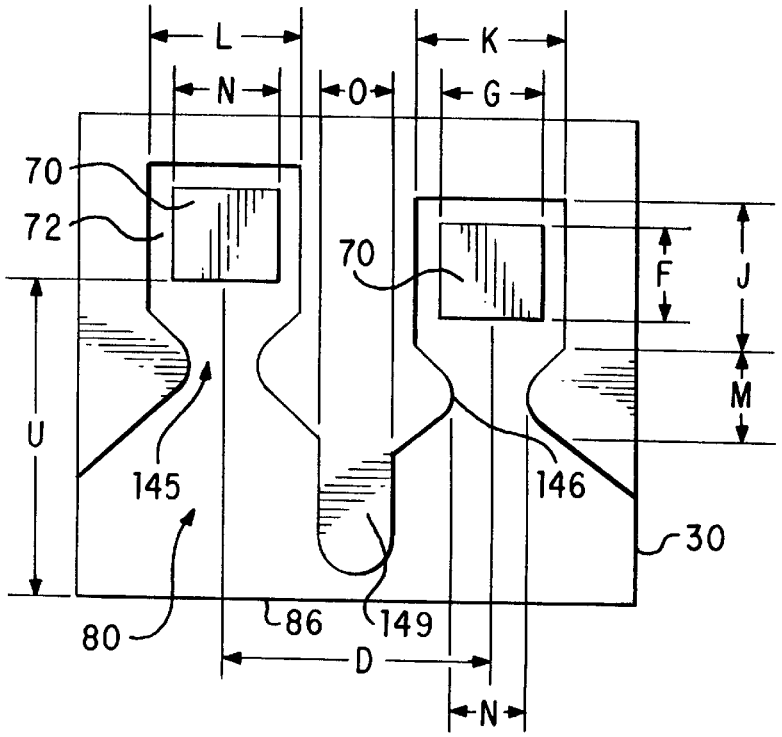
FIG. 6 is a top plan view of a magnified portion of the printhead assembly showing the relationship of ink channels, vaporization chambers, heater resistors, the barrier layer and an edge of the substrate.

In FIG. 6, vaporization chambers 72 and ink channels 80 are shown formed in barrier layer 30. Ink channels 80 provide an ink path between the source of ink and the vaporization chambers 72. The flow of ink into the ink channels 80 and into the vaporization chambers 72 is around the long side edges 86 of the substrate 28 and into the ink channels 80. The relatively narrow constriction points or pinch point gaps 145 created by the pinch points 146 in the ink channels 80 provide viscous damping during refill of the vaporization chambers 72 after firing. The pinch points 146 help control ink blow-back and bubble collapse after firing to improve the uniformity of ink drop ejection. The addition of "peninsulas" 149 extending from the barrier body out to the edge of the substrate provided fluidic isolation of the vaporization chambers 72 from each other. The definition of the various printhead dimensions are provided in Table I.

TABLE I

DEFINITION OF INK CHAMBER DEFINITIONS

| Dimension | Definition |
|---|---|
| A | Substrate Thickness |
| B | Barrier Thickness |
| C | Nozzle Member Thickness |
| D | Orifice/Resistor Pitch |

TABLE I-continued

DEFINITION OF INK CHAMBER DEFINITIONS

| Dimension | Definition |
|---|---|
| E | Resistor/Orifice Offset |
| F | Resistor Length |
| G | Resistor Width |
| H | Nozzle Entrance Diameter |
| I | Nozzle Exit Diameter |
| J | Chamber Length |
| K | Chamber Width |
| L | Chamber Gap |
| M | Channel Length |
| N | Channel Width |
| O | Barrier Width |
| U | Shelf Length |

The frequency limit of a thermal inkjet print cartridge is limited by resistance in the flow of ink to the nozzle. However, some resistance in ink flow is necessary to damp meniscus oscillation. Ink flow resistance is intentionally controlled by the pinch point gap 145 gap adjacent the resistor. An additional component to the fluid impedance is the entrance to the firing chamber. The entrance comprises a thin region between the nozzle member 16 and the substrate 28 and its height is essentially a function of the thickness of the barrier layer 30. This region has high fluid impedance, since its height is small. The dimensions of the various elements formed in the barrier layer 30 shown in FIG. 6 are identified in Table II below.

TABLE 2

INK CHAMBER DIMENSIONS IN MICRONS

| Dimension | Minimum | Nominal | Maximum |
|---|---|---|---|
| A | 600 | 625 | 650 |
| B | 19 | 25 | 32 |
| C | 25 | 50 | 75 |
| D | | 84.7 | |
| E | 1 | 1.73 | 2 |
| F | 30 | 35 | 40 |
| G | 30 | 35 | 40 |
| I | 20 | 28 | 40 |
| J | 45 | 51 | 75 |
| K | 45 | 51 | 55 |
| L | 0 | 8 | 10 |
| M | 20 | 25 | 50 |
| N | 15 | 30 | 55 |
| O | 10 | 25 | 40 |
| U | 0 | 90–130 | 270 |

The nozzle member 16 in circuit 18 is positioned over the substrate structure 28 and barrier layer 30 to form a printhead 14. The nozzles 17 are aligned over the vaporization chambers 72. Preferred dimensions A, B, and C (not shown in FIG. 6) are defined as follows: dimension A is the thickness of the substrate 28, dimension B is the thickness of the barrier layer 30, and dimension C is the thickness of the nozzle member 16. Further details of the printhead architecture are provided in U.S. application Ser. No. 08/319,893, filed Oct. 6, 1994, entitled "Barrier Architecture for Inkjet Printhead;" which is herein incorporated by reference.

From Table II it can be seen that the nominal channel width of 30 microns and nominal channel height of 25 microns, allows for channel blockage by very small bubble diameters.

Figure 7:
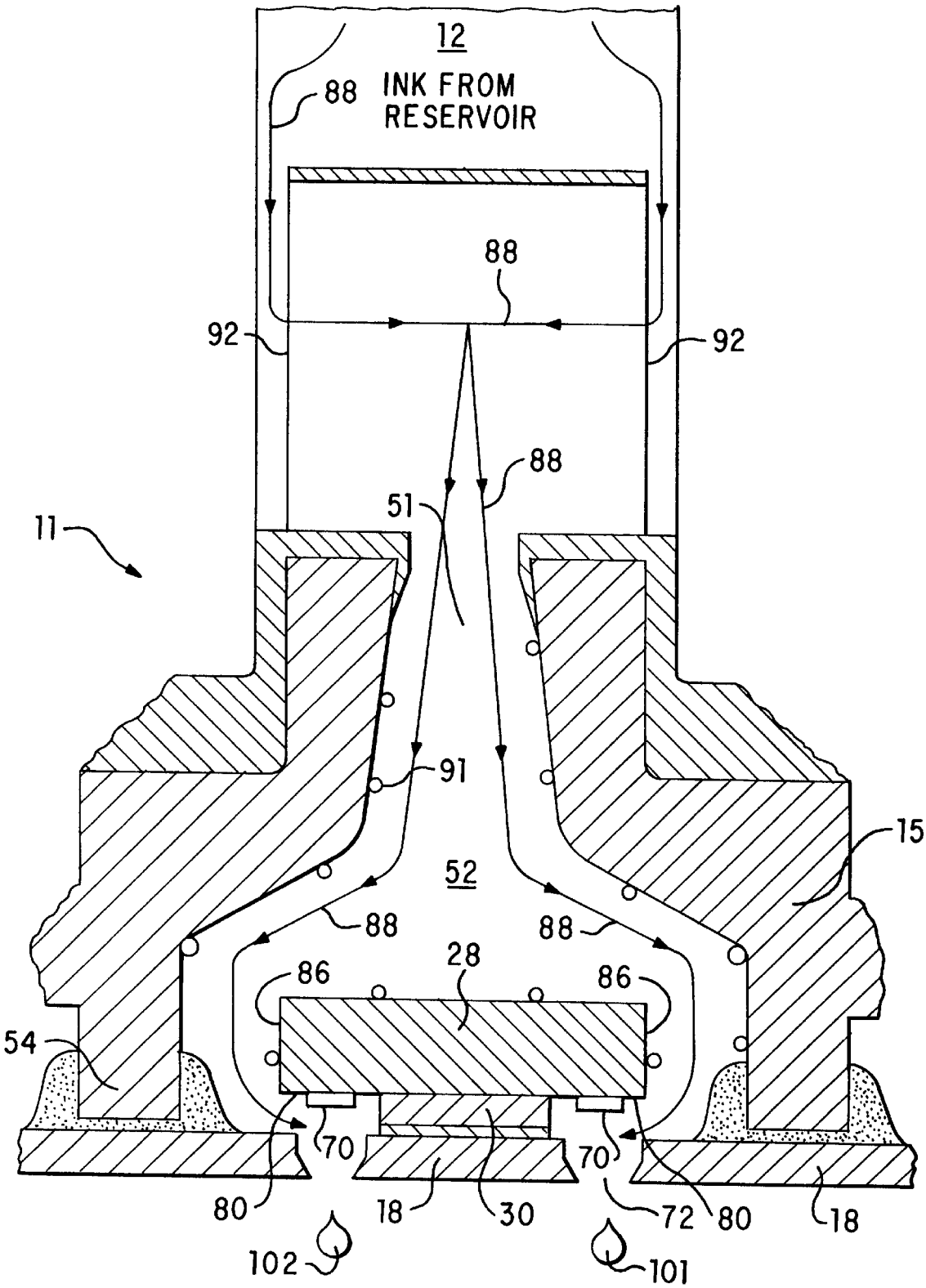
FIG. 7 is a schematic diagram showing the ink flow path from the ink reservoir to the head.

FIG. 7 shows how ink containing dissolved gases flows from the ink reservoir 12 of the ink cartridge 10 through filters 92 along ink flow path 88 through standpipe 51 in the snout 11, into manifold 52, around the edge 86 of substrate 28, along ink channels 80 and into vaporization chambers 72 before being ejected out of the nozzles 17. During operation, warm thermal boundary layers of ink 88 form adjacent the substrate 28. Therefore, dissolved gases in the thermal boundary layer of the ink 88 behind the substrate 28 tend to form and diffuse into the bubbles 89. Also, bubbles 91 tend to form at the corners and edges of the walls 55 along the ink flow path 88. In addition, the region between the manifold 52 and substrate 28 acts as an accumulator or bubble trap. This configuration amounts to a chamber on the ink flow path 88 with an entrance and an exit. The average ink flow rate, in terms of volume ink per cross section of area per second, is smaller within the chamber than at the entrance or at the exit. The entrance edge of the vaporization chamber 72 will act as a gas generating site because of its sharpness and because of the discontinuity of ink flow over the edge. Bubbles will be generated in this chamber and when they become large enough they get moved along toward the ink chamber. If the chamber allows bubbles to grow larger than the diameter of subsequent ink passageways which may then become blocked. These bubbles choke the flow of ink to the vaporization chambers 72, especially at high firing frequencies, i. e., greater than 8 kHz. This results in causing some of the nozzles 17 to temporarily become inoperable. Although the total amount of dissolved gases contained within the fluid volume of the boundary layer is small, in reality, all of the ink in the reservoir 12 will eventually flow along ink path 88 over the lifetime of the print cartridge 10. If all, or even some, of the dissolved gas contained within the ink reservoir 12 outgasses, substantial bubbles will form. When the bubbles become large enough they get moved along toward the ink chamber. If the bubbles grow larger than the diameter of subsequent ink passageways, the passageways may become blocked and choke the flow of ink to the vaporization chambers 72. This results in causing some of the nozzles 17 to temporarily become inoperable.

Bubbles in the ink near the printhead 14 of an inkjet print cartridge 10 is one of the most critical problems that impairs the performance of the print cartridge. Bubbles arise from several causes: (1) bubbles are trapped in the ink feed channels during filling and priming of the print cartridge and (2) bubbles are formed at bubble "seed sites" in the fibrous carbon-filled material of walls 57, 58 of the print cartridge body 15 during operation. As the ink is heated during printing, dissolved air outgasses from the ink and is accreted onto these trapped bubbles and seed sites, resulting in bubbles that grow over time. The bubbles block the nozzles 17 from ejecting ink and if the blockage is large enough it can cause the entire printhead 14 to suffer "global starvation." Bubbles have been a problem in the past, but they are a much more serious problem in a 600 dot per inch ("dpi") printhead. This is due primarily to the reduced size of the ink flow channels 80 and nozzles 17 diameter as set forth in the above description with respect to FIG. 6 and accompanying Table II. However, this is also due to the higher firing frequencies and consequent flow rates of ink ejection. Because the venturi forces that pull bubbles toward the firing chambers are now higher, the tendency for bubbles to interfere with nozzle operation is greater.

Several methods of controlling bubbles in inkjet print cartridges 10 have been employed including: (1) making the ink feed channel more "bubble-tolerant" by deepening the headland area 50 behind the printhead 14 to make room for bubbles to float up and away from the nozzles 17, and (2) flushing the empty cartridge with carbon dioxide prior to fill.

The printhead was redesigned to be more tolerant of existing bubbles. The most critical areas for the design is the area around the filters, the standpipe, and the headland. The goals are to minimize dead spaces, streamline the geometry for fluid flow and allow bubbles to easily escape from the printhead area. Since the pen prints with the nozzles downward, the ink manifold behind the printhead substrate was redesigned. The manifold was made deeper, to allow a space for bubbles to drift upward and away from the nozzles. See U.S. patent application Ser. No. 08/550,143, filed Oct. 30, 1995, entitled "Bubble Tolerant Manifold Design for Inkjet Cartridge".

The continued presence of trapped bubbles despite the above efforts, resulted in several other attempted solutions. It was discovered that by incorporating a carbon dioxide flush of the print cartridge 10, trapped bubbles were further eliminated. The print cartridge is first filled with carbon dioxide gas, and then filled with ink. By flushing the print cartridge 10 with carbon dioxide prior to ink filling and priming, the residual bubbles are carbon dioxide gas, rather than air, which have a much higher solubility in the ink than bubbles composed of air (oxygen and nitrogen) and the bubbles quickly dissolve and disappear.

This elimination of residual bubbles by carbon dioxide gas flush turned out to be effective for both anionic inks, which were able to dissolve up to 220 percent of their volume in carbon dioxide gas and cationic inks which were able to dissolve 73 percent of their volume in carbon dioxide gas. Since the total gas trapped in a print cartridge during the filling and priming process is approximately 1 to 2 cc in volume versus approximately 50 cc of ink, total absorption of carbon dioxide gas is easily possible. Further experiments showed that carbon dioxide flush is very effective; entrapped bubbles were virtually eliminated within an hour of filling and priming and had disappeared entirely within 24 hours.

Figure 8:
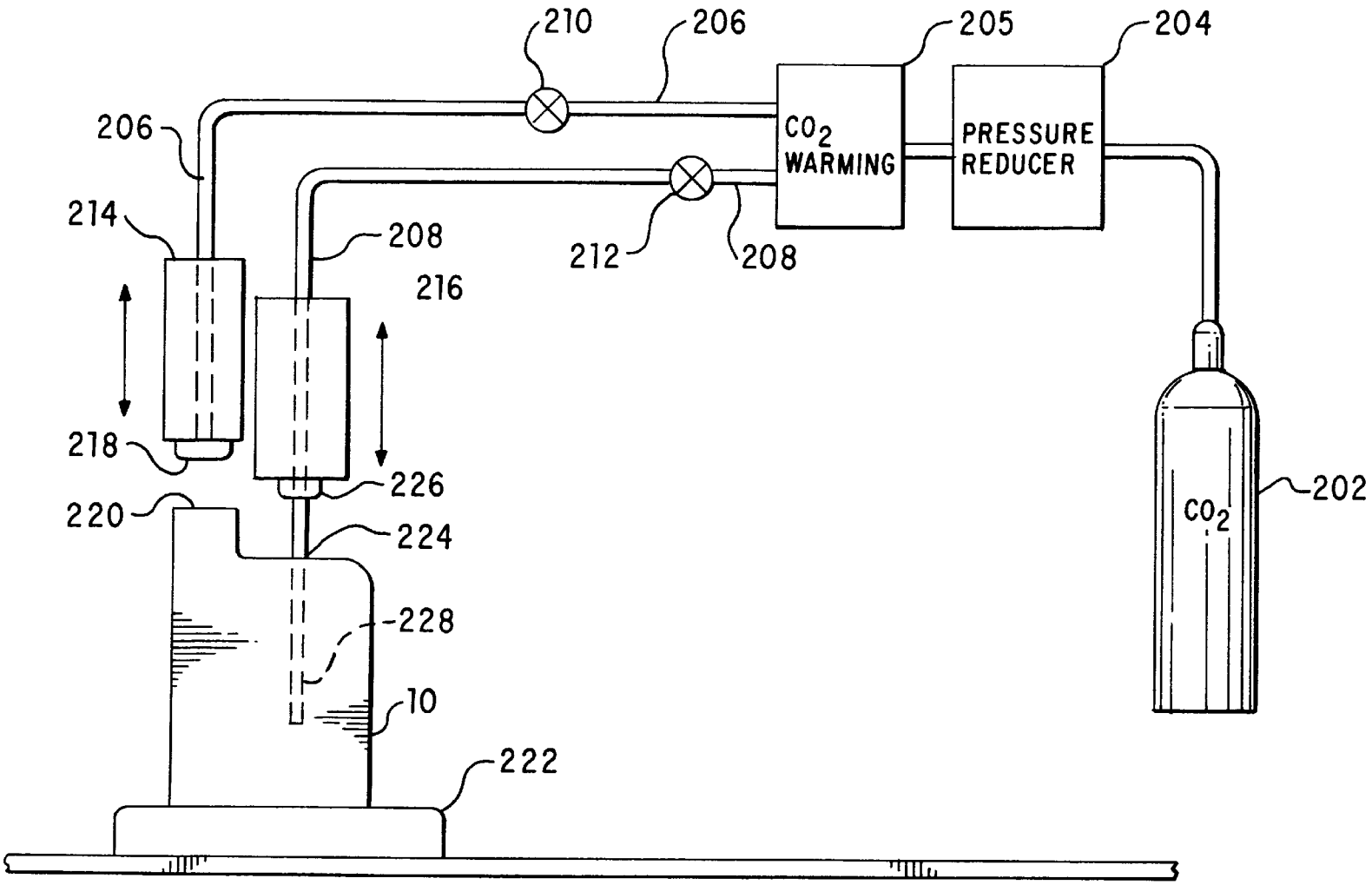
FIG. 8 is a schematic diagram showing the carbon dioxide gas flushing apparatus.

Shown in FIG. 8 is a schematic diagram showing the carbon dioxide gas flushing apparatus. The carbon dioxide source can be located off-line. The flushing apparatus is very compact and can be located on the print cartridge assembly line immediately before the ink fill station. The carbon dioxide gas is provided from carbon dioxide source 202 and passes through pressure reducer 204, carbon dioxide warmer 205, and then into supply tubes 206 and 208, and then passes through pressure and flow controllers 210 and 212, respectively. Supply tube 206 provides carbon dioxide under control of valve 210 to headland slide mechanism 214 and supply tube 208 provides carbon dioxide under control of valve 212 to fill port slide mechanism 216. The pressure of the carbon dioxide gas at the headland slide 214 is approximately 25 to 40 psi and the pressure at the fill port slide 216 is approximately 15 to 30 psi, respectively.

Headland slide mechanism 214 lowers to engage the print cartridge printhead or headland area 220. Headland slide 214 has a means of tolerance compliance designed into it so it will locate off of features on the print cartridge 10 as it comes down to address the print cartridge 10 on the pallet 222. The headland slide 214 has a boot 218 that seals onto the nozzles 17 in headland area 220 of the print cartridge 10 to allow carbon dioxide to be passed into the print cartridge through nozzles 17. The headland slide 214 can alternatively be plumbed to apply a vacuum to nozzles 17 via a valve to headland area 220 in accordance with an alternative procedure set forth below.

Fill port slide mechanism 216 engages the ink fill port 224 of print cartridge 10. The fill port slide 216 can be retracted as the fill port slide comes down and is used for alignment while the needle comes down, and also as a means to plug the port. The fill needle 228 is mounted to the fill port slide 216, which aligns off the headland slide 214. In a first position, the fill port slide 216 is lowered so that fill needle 228 passes through fill port 224 and the end of fill needle 228 is located toward the bottom of cartridge 10. In this first position, an annular ring exists between fill needle 228 and fill port 224 to allow air and carbon dioxide to escape from the cartridge 10 through fill port 224. Fill port slide 216 is further lowered to a second position, so that tapered top section 226 of the fill port needle 228 seals with the ink fill port 224 to plug the print cartridge fill port 224 of print cartridge 10.

Figure 9:
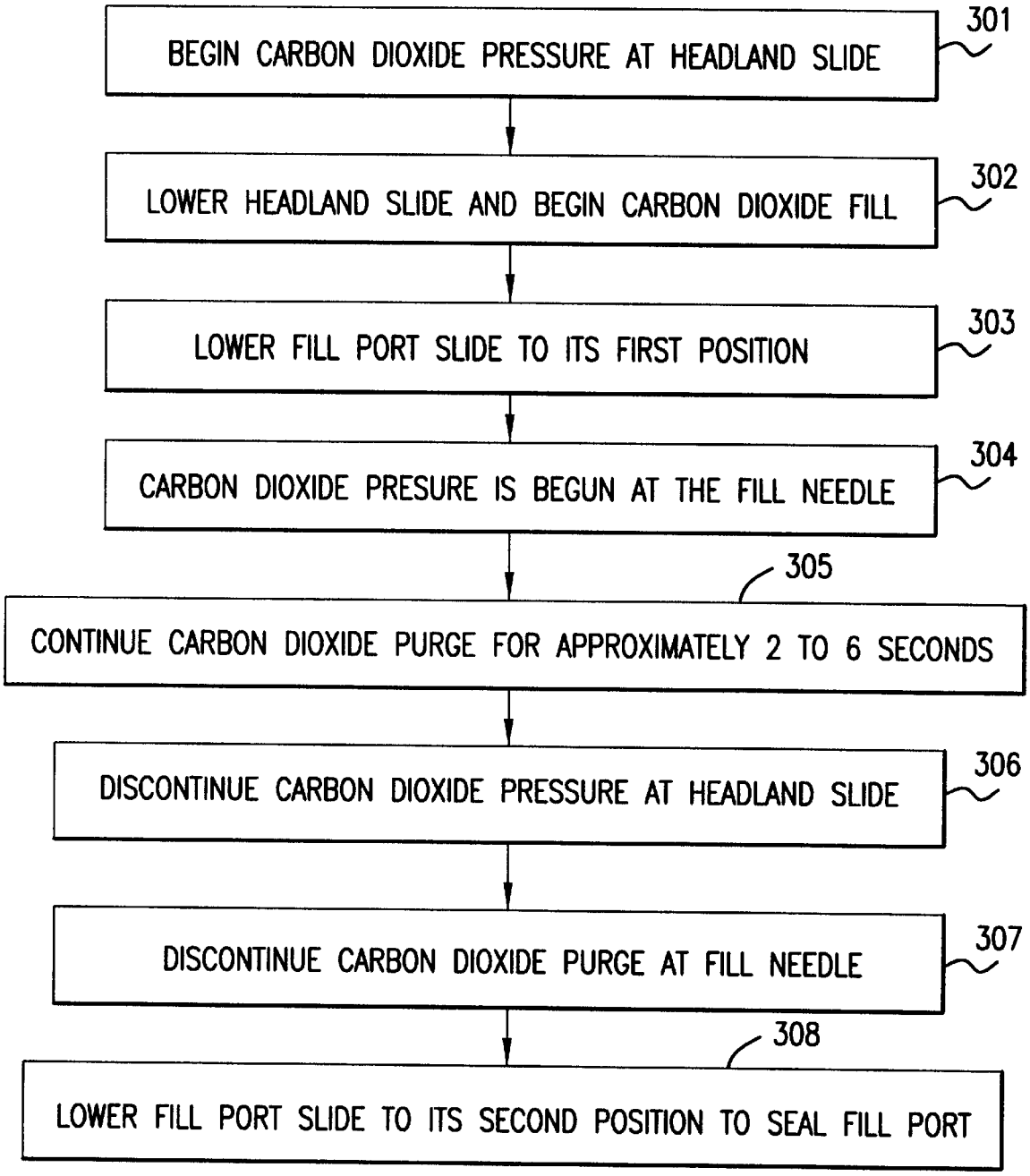
FIG. 9 is a flow diagram showing a carbon dioxide gas flushing procedure.

Referring to FIG. 9, in the preferred embodiment, the process is as follows. In step 301, begin carbon dioxide pressure at headland slide 214. In step 302, lower headland slide 214 to engage boot 218 to the nozzles 17 in headland 220 of print cartridge 10 and begin carbon dioxide fill at headland 220. In step 303, lower fill port slide 216 to its first position so that fill needle 228 passes through fill port 224 and the end of fill needle 228 is located toward the bottom of cartridge 10. The carbon dioxide film needle 228 engages the fill port 224 leaving an annular ring at the top open. In step 304, carbon dioxide pressure is begun at the fill needle 228 and the carbon dioxide begins to purge the print cartridge of air. The air in the print cartridge mostly exits through the annular ring at the top of the fill port. In step 305, continue carbon dioxide purge for approximately 2 to 6 seconds. In step 306, discontinue carbon dioxide pressure at headland slide. In step 307, discontinue carbon dioxide purge at fill needle 228. In step 308, lower fill port slide 216 to its second position so that tapered end 226 seals fill port 224.

The boot 218 of headland slide 214 continues to seal the headland area 220 and tapered end 226 continues to seal fill port 224 until the print cartridge is ready to be filled.

Figure 10:
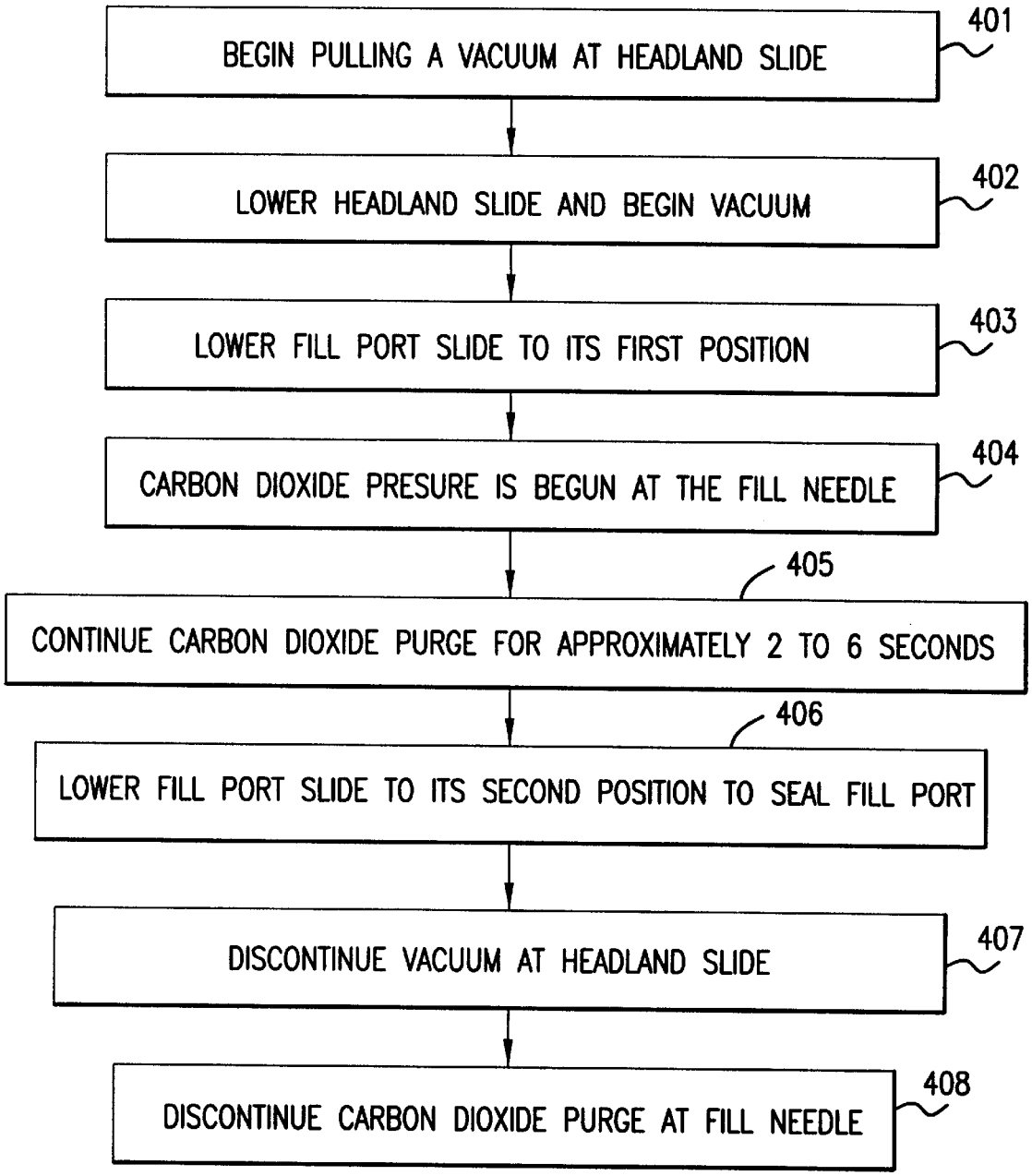
FIG. 10 is a flow diagram showing a carbon dioxide gas flushing procedure.

Referring to FIG. 10, in an alternative embodiment, the process is as follows. In step 401, begin pulling a vacuum at headland slide 214. In step 402, lower headland slide 214 to engage boot 218 to headland 220 of print cartridge 10 and begin vacuum at headland 220. In step 403, lower fill port slide 216 to its first position so that fill needle 228 passes through fill port 224 and the end of fill needle 228 is located toward the bottom of cartridge 10. The carbon dioxide fill needle 228 engages the fill port 224 leaving an annular ring at the top open. In step 404, carbon dioxide pressure is begun at the fill needle 228 and the carbon dioxide begins to purge the print cartridge of air. The air in the print cartridge mostly exits through the annular ring at the top of the fill port. In step 405, continue carbon dioxide purge for approximately 2 to 6 seconds. In step 406, lower fill port slide 216 to its second position so that tapered end 226 seals fill port 224. In step 407, discontinue vacuum at headland slide. In step 408, Discontinue carbon dioxide purge at fill needle 228.

The boot 218 of headland slide 214 continues to seal the headland area 220 and tapered end 226 continues to seal fill port 224 until the print cartridge is ready to be filled.

The carbon dioxide flush apparatus can hold a carbon dioxide flushed print cartridge sealed for up to 15 minutes without loss of the positive effects of the flush; whereas a flushed, unsealed at the fill port 224 print cartridge 10 would lose the benefits of carbon dioxide flush after only 10 seconds. Carbon dioxide, being denser than air, tends to escape out the ink fill hole and "slump" down out of the manifold area, thus leaving air, not carbon dioxide, to be trapped as bubbles upon print cartridge priming.

Prior to the use of carbon dioxide flush, residual bubbles remained in the print cartridges. Eliminating the residual bubbles has had a dramatic impact on long term print cartridge reliability.

It will be understood that the foregoing disclosure is intended to be merely exemplary, and not to limit the scope of the invention, which is to be determined by reference to the appended claims.

What is claimed is:

1. A method for reducing residual air bubbles in an inkjet print cartridge containing ink, comprising:

providing an empty inkjet print cartridge having an ink fill port;

providing a source of carbon dioxide; and flushing air from the empty inkjet print cartridge by passing the carbon dioxide under pressure into the empty inkjet print cartridge through a fill needle positioned within the ink fill port.

2. The method of claim 1 wherein flushing air from the empty inkjet print cartridge further comprises allowing the air and carbon dioxide to pass out of the inkjet print cartridge through the fill port, adjacent the fill needle positioned within the fill port, while passing the carbon dioxide under pressure into the empty cartridge through the fill needle.

3. The method of claim 1 wherein flushing air from the empty inkjet print cartridge further comprises allowing carbon dioxide into the empty inkjet print cartridge through ink ejection nozzles formed therein and allowing the air and carbon dioxide to pass out of the empty inkjet print cartridge, adjacent the fill needle positioned within the fill port.

4. The method of claim 1 wherein flushing the empty inkjet print cartridge continues for approximately one to ten seconds.

5. The method of claim 1 comprising sealing the ink fill port of the empty cartridge after flushing with carbon dioxide.

6. The method of claim 1 comprising filling the empty inkjet print cartridge with ink through the ink fill port after flushing with carbon dioxide.

7. A method for reducing residual air bubbles remaining in an inkjet print cartridge after filling, comprising:

providing an empty inkjet print cartridge having an ink fill port and ink ejection nozzles for ejecting ink on a print media;

providing a source of carbon dioxide;

applying a vacuum at the ink ejection nozzles; and flushing the empty inkjet print cartridge by passing the carbon dioxide under pressure into the empty inkjet print cartridge through a fill needle positioned within the ink fill port in order to remove air from inside the empty inkjet print cartridge through said ink ejection nozzles.

8. The method of claim 7 wherein flushing the empty inkjet print cartridge further comprises allowing the air and carbon dioxide to pass out of the empty inkjet print cartridge through the ink fill port, adjacent the fill needle positioned within the fill port, while passing the carbon dioxide under pressure into the empty inkjet print cartridge through the fill needle.

9. The method of claim 7 wherein flushing the empty inkjet print cartridge continues for approximately one to ten seconds.

10. The method of claim 7 comprising sealing the ink fill port of the empty inkjet print cartridge after flushing with carbon dioxide.

11. The method of claim 7 comprising filling the empty inkjet print cartridge with ink through the ink fill port after flushing with carbon dioxide.

* * * * *